US011478050B2

(12) United States Patent
Fiedler et al.

(10) Patent No.: US 11,478,050 B2
(45) Date of Patent: Oct. 25, 2022

(54) CLOSURE DEVICE FOR RELEASABLY CONNECTING TWO PARTS

(71) Applicant: Fidlock GmbH, Hannover (DE)

(72) Inventors: Joachim Fiedler, Hannover (DE); Philip Klein, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 16/540,314

(22) Filed: Aug. 14, 2019

(65) Prior Publication Data

US 2020/0054101 A1 Feb. 20, 2020

(30) Foreign Application Priority Data

Aug. 16, 2018 (DE) ..... 10 2018 213 836.2

(51) Int. Cl.
*A44B 11/25* (2006.01)

(52) U.S. Cl.
CPC ..... *A44B 11/25* (2013.01); *A44B 11/258* (2013.01); *A44D 2203/00* (2013.01)

(58) Field of Classification Search
CPC ... A44B 11/25; A44B 11/258; A44D 2203/00; A41F 1/002
See application file for complete search history.

(56) References Cited

U.S. PATENT DOCUMENTS 5,253,394 A 10/1993 Morita
7,849,569 B2 * 12/2010 Cope ..... A44C 5/2042 24/303
10,085,521 B2 * 10/2018 Chen ..... A45C 13/1069
10,212,993 B2 * 2/2019 Fiedler ..... A44B 11/2588
10,362,838 B2 * 7/2019 Fildan ..... A41F 1/002
10,701,998 B2 * 7/2020 Fildan ..... A41F 1/002
2004/0107547 A1 6/2004 Chung
2007/0107169 A1 5/2007 Kung
2015/0135486 A1 * 5/2015 Fiedler ..... A44B 11/2584 24/303
2016/0073744 A1 * 3/2016 Fiedler ..... A44B 11/2588 24/303
2018/0360147 A1 12/2018 Fiedler et al.
2019/0343239 A1 * 11/2019 Fiedler ..... A44B 11/258

FOREIGN PATENT DOCUMENTS

JP H559861 A 3/1993
WO 2017125229 A1 7/2017
WO 2018229221 A1 12/2018

* cited by examiner

*Primary Examiner* — Robert Sandy
*Assistant Examiner* — Rowland Do
(74) *Attorney, Agent, or Firm* — The Webb Law Firm

(57) ABSTRACT

Disclosed is a closure device for releasably connecting two parts, including a first closure part which includes a first base body, and a second closure part which includes a second base body. The first closure part and the second closure part can be attached to each other such that in a closed position the first base body and the second base body at least partly are at least positively connected with each other to support a load acting between the first closure part and the second closure part along a load direction, and holding of the first and second closure parts against each other in the closed position is magnetically supported. An engagement opening is formed on the first base body as a through opening into which an engagement portion of the second base body protrudes in the closed position.

14 Claims, 14 Drawing Sheets

(A-A)

(B-B)

(A-A)

CLOSURE DEVICE FOR RELEASABLY CONNECTING TWO PARTS

CROSS-REFERENCE TO RELATED APPLICATION

This application claims priority to German Patent Application No. 10 2018 213 836.2 filed Aug. 16, 2018, the disclosure of which is hereby incorporated by reference in its entirety.

BACKGROUND OF THE INVENTION

Field of the Invention

The disclosure relates to a closure device for releasably connecting two parts with each other.

Description of Related Art

Such a closure device comprises a first closure part, which includes a first base body, and a second closure part, which includes a second base body. The first closure part and the second closure part can be attached to each other such that in a closed position the first base body and the second base body at least partly are at least positively connected with each other to support a load acting between the first closure part and the second closure part along a load direction. Holding the first and second closure parts against each other is magnetically supported in the closed position in order to facilitate taking of the closed position and to specify a proper alignment of the first and second closure parts relative to each other in the closed position. Attaching the closure parts to each other also can be magnetically supported, namely by a magnetically attracting effect of magnets of the first and second closure parts.

Such a closure device can be used for example on articles of clothing, for example on a shoe, a shirt, a jacket or the like. Such a closure device can, however, also be used for example on a bag or another accessory and likewise on a medical implement such as an orthosis or a prosthesis.

It is desirable in principle to be able to variably mount such a closure device without for example the wearing comfort or the handleability being negatively impaired for a user to a significant extent. In particular, such a closure device should be easy to close and also to open again, should be able to absorb all loads in the closed position, both along a shear direction and along the load direction, so that the parts connected with each other along the closing direction cannot easily be released from each other due to the load.

It is an object of the proposed solution to provide a closure device for releasably connecting two parts, which can be used variably, in particular for example on articles of clothing, and is easy to handle for a user, i.e. in particular can be opened and closed easily.

This object is achieved in particular by a closure device with features as described herein.

There is proposed a closure device in which a first base body of the first closure part is provided with an engagement opening and a second base body of the second closure part at least includes an engagement portion formed on the second base body. In the closed position, the engagement portion of the second base body is at least partly received in the engagement opening of the first base body to support the load acting along the load direction. The engagement opening here is formed on the first base body as a through opening into which the engagement portion protrudes in the closed position. Since the engagement opening for the engagement portion is configured as a through opening, e.g. possibly present ferromagnetic dirt settling in the engagement opening can be removed more easily. Furthermore, the second closure part including the engagement portion easily can be dimensioned in a protruding way so that in the case of occurring loads an additional "play" still is present. Thus, the engagement portion can dip further into the engagement opening and hence even intensify a positive and possibly non-positive abutment of the two closure parts against each other. Furthermore, via the formation as a through opening an engagement depth of the engagement portion is comparatively variable, without a safe, in particular positive retention of the first and second base bodies against each other being negatively influenced. In this way, the closure device can also be used easily on parts of different thickness.

In one design variant, the engagement portion of the second closure part passes through the engagement portion in the closed position. Thus, the engagement portion extends through the engagement opening, possibly the engagement portion then even at least slightly protrudes on one side of the engagement opening with an end passing through the engagement opening.

For example, the engagement portion is configured to protrude from the second base body in the manner of a web, in particular to protrude transversely to the load direction. Alternatively or in addition, two portions formed on the first base body can be spaced apart from each other along the load direction and between themselves form the engagement opening configured as a through opening. Then, for example the engagement of the engagement portion into the engagement opening defined on the first base body as a space between two adjacent portions creates a support against the load direction due to which the closure parts are held against each other in the closed position.

Supported by the magnetic attraction of the closure parts, the engagement portion is held between the adjacent portions of the first base body, wherein a (static) friction between the portions defining the engagement opening and the engagement portion can exist, which ensures a hold of the closure parts against each other also under comparatively great loads and possibly a deformation at the base bodies due to the load.

An engagement portion protruding in the manner of a web in cross-section for example can have a basic shape which corresponds to the shape of a non-right-angled parallelogram.

In an alternative design variant the engagement portion is of pin-like design and protrudes from the second base body, in particular transversely to the load direction. The protruding pin-like engagement portion can be of rotationally symmetrical design and/or comprise a mushroom-head-shaped end portion at an end which in the closed position extends into or through the engagement opening. A rotationally symmetrical configuration of the engagement portion, e.g. also with a mushroom-head-shaped end portion, can be advantageous in particular in so far as the load direction is insignificant when being mounted to the parts to be connected. A positive connection of the base bodies here can be realized transversely to a closing direction independent of the load direction. The same then applies for hooking behind a possibly present rotationally symmetrical, mushroom-head-shaped end portion.

The engagement portion furthermore can include an undercut region against which a portion of the first closure part bordering the engagement opening rests in the closed position and under a load acting on the second closure part in the load direction and which at least partly engages over the portion bordering the engagement opening. Hence, an undercut is formed on the engagement portion, which in the closed position holds the base bodies at each other against the closing direction. A corresponding undercut region for example can be formed by a mushroom-head-shaped end portion of the engagement portion. By the engagement portion at least partly engaging over the portion bordering the engagement opening the first and second closure parts then are (additionally) positively held against each other.

In principle, the engagement portion, in particular an engagement portion of web-like or pin-shaped design, can be linearly extended transversely to the load direction. It is also conceivable and possible, however, that the engagement portion is extended on the second base body in a curved or inclined way.

In one design variant the engagement portion includes an abutment surface which in the closed position is in contact with a portion of the first closure part bordering the through opening in order to support a load acting on the second closure part in the load direction. Via such an abutment surface a (static) friction is effected between the engagement portion of the second closure part, due to which the first and second closure parts also are reliably held against each other under a load so that the closure parts cannot easily be released from each other due to the load.

In a development, the abutment surface is inclined relative to the load direction and to a closing direction, along which the first closure part and the second closure part can be attached to each other, such that in the case of a load acting on the second closure part in the load direction the engagement portion is loaded with a force component in closing direction relative to the first closure part. The engagement of the engagement portion into the engagement opening thus is self-amplifying under a load. Due to the inclination of the abutment surface, a force component (obtained by vector splitting) acts in the closing direction under a load in the load direction and thus in the direction of an engagement of the engagement portion of the second closure part into the engagement opening on the base body of the first closure part.

A portion of the closure part bordering the engagement opening for example can include an abutment surface which is complementary to the abutment surface of the engagement portion of the second closure part so that in the closed position a planar abutment exists between the abutment surfaces associated with each other.

Holding the first and second closure parts against each other in the closed position in principle can be magnetically supported by at least one magnet of the first or second closure part. For this purpose, a (permanent) magnet for example can be accommodated on the first or second closure part.

In a design variant, at least one magnet of the first closure part and/or at least one magnet of the second closure part is magnetized along a magnetization direction collinear with the load direction. The north pole and south pole of the magnets thus are offset from each other along the load direction. In particular when the magnets are provided directly on the engagement portion and a portion bordering the engagement opening, a magnetic attraction between the at least one portion of the first closure part bordering the engagement opening and the engagement portion of the second closure part thus is obtained in the closed position along a direction that is collinear with the load direction. In this way, for example an advantageous (static) friction can be adjusted between the portions of the two base bodies.

In one design variant of a proposed closure device it is provided that between the first base body and the second base body a previously defined clearance is formed in the closed position. This predefined clearance in particular can be formed in the surroundings of the engagement portion so that regions of the second base body of the second closure part adjacent to the above-mentioned engagement portion are spaced apart from the first base body of the first adjustable part including the engagement opening. This for example provides an additional dipping reserve and hence the possibility that the engagement portion, if necessary, can dip further into the continuous engagement opening—by at least partly bridging the predefined clearance—, for example when the closure device is exposed to a greater load.

Depending on the application of the closure device, the predefined clearance furthermore can serve to provide for a coverage of regions of the second base body by the part on which the second closure part is provided. Then, for example, a fabric of an article of clothing on which the closure device is provided can protrude into the provided clearance.

Another aspect of the proposed solution relates to a closure device in which the engagement portion is of rotationally symmetrical design and/or formed with a mushroom-head-shaped end portion extending through the engagement opening.

As already explained above, such a configuration of the engagement portion (and a configuration of the engagement opening possibly corresponding therewith) involves some advantages for the solution of this problem. The rotationally symmetrical design of an engagement portion and/or the configuration of an engagement portion provided with a mushroom-head-shaped, in particular likewise rotationally symmetrical, mushroom-head-shaped end portion is independent of the design of the engagement opening as a through opening, but can of course easily be combined therewith.

Furthermore, in connection with the proposed solution it is provided according to another aspect that one of the first or second base bodies of the first and second closure parts is of ring-shaped or ring-disk-shaped design.

The use of a ring-shaped or ring-disk-shaped base body, in particular of a circular ring-shaped or circular ring-disk-shaped base body—independent of the two aforementioned aspects to be combined therewith—can provide for a compact and inexpensive design of the closure device.

A ring-shaped or ring-disk-shaped design of a base body, possibly in combination with a rotationally symmetrical engagement portion, furthermore can provide for an attachment of the two closure parts to each other substantially independent of the direction of attachment and hence additionally facilitate the handling for a user of the closure device.

For example, the ring-shaped or ring-disk-shaped base body is completely made of a magnetic, ferromagnetic or magnetized material. For example, a ring-shaped or ring-disk-shaped base body can be configured with a toroidal magnet or be formed by a toroidal magnet.

In one design variant the ring-shaped or ring-disk-shaped first or second base body is formed with a through opening provided substantially centrally on the base body. For the positive connection of the first and second closure parts, an engagement portion of a closure part in the closed position engages into this centrally provided through opening of the other closure part. The ring-shaped or ring-disk-shaped base body thus for example can be attachable to an engagement portion protruding in the manner of a web or pin.

In an alternative design variant the ring-shaped or ring-disk-shaped base body is configured with a through opening provided substantially centrally on the base body, wherein for the positive connection of the first and second closure parts at least one element of the second or first closure part at least partly engages over a portion bordering the through opening on the base body of the other, first or second closure part. A positive connection between the base bodies of the two closure parts thus is not realized via the engagement of an engagement portion into the centrally provided through opening, but by an additional element which in the closed position engages over a portion on the other base body and hence for example defines an undercut region.

Independent of the intended use of the through opening provided on the ring-shaped or ring-disk-shaped base body it can be provided in a development that the ring-shaped or ring-disk-shaped base body in addition to the substantially centrally provided through opening comprises at least one further continuous opening for a flexible tightening element which in the closed position transmits the load acting along the load direction to the closure parts. A tightening element of the closure device, e.g. in the form of a shoelace, a cord, a rope, a string or a ribbon, thus is held on an additionally provided opening of the ring-shaped or ring-disk-shaped base body. Such an additional continuous opening for example can be formed like a channel or in the form of an eyelet on the respective base body. The ring-shaped or ring-disk-shaped base body thus forms at least one opening via which a flexible tightening element is held on the base body.

According to another aspect of the proposed solution a closure device can be provided in addition thereto or independent thereof, which in particular is suitable for releasably connecting two parts on an article of clothing and in which on at least one of the first and second base bodies at least one continuous opening is formed, through which a flexible tightening element is guided, which in the closed position transmits the load acting along the load direction to the closure parts. On the continuous opening the tightening element then is held on the first or second base body including the continuous opening.

The at least one continuous opening for example can be provided at a distance to an engagement opening which is likewise formed on the first or second base body including the continuous opening and into which an engagement portion of the other, second or first base body engages in the closed position.

The continuous opening for example can extend in the first or second base body in the manner of a channel or be formed on the first or second base body in the form of an eyelet.

In the case of a continuous opening extending in the manner of a channel the same in one design variant for example extends substantially perpendicularly to a closing direction of the closure device, along which the first and second closure parts can be attached to each other, and substantially perpendicularly to a displacement direction along which the closure parts are to be displaced relative to each other by engaging a grip element of the closure device in order to release the first and second closure parts from each other. In a (circularly) ring-shaped or (circularly) ring-disk-shaped base body an opening extending in the manner of a channel for example can extend substantially along a secant of a circular shape enclosing the contour of the base body.

In an alternative design variant, the continuous opening through which the flexible tightening element is guided and is held on the first or second base body is formed centrally on the first or second base body. A central opening of a for example ring-shaped or ring-disk-shaped base body then serves for holding the flexible tightening element. In addition, a possibly present grip element likewise can pass through the central opening with one portion and thereby be held on the respective base body.

In an embodiment explained above, in which the tightening element is held on a centrally provided opening, an element of the second or first closure part can at least partly engage over a portion bordering the opening on the base body of the other, first or second closure part including the opening for the positive connection of the first and second closure parts in the closed position. When the closure device is closed, a corresponding spanning element here primarily can absorb shear forces and possibly certain tilting forces—via a corresponding undercut region.

In principle, a corresponding spanning element of the one base body—based on the closed position—can be arranged laterally offset from a region in which an opening for a tightening element is provided on the other base body. A possible load introduced into the respective base body via the tightening element thus is laterally supported by the spanning element of the other base body. In particular, possibly existing tilting forces and shear forces in this way can easily be absorbed on an outer circumference of a base body.

Independent of the configuration of the closure device according to one of the different aspects explained above, which in principle can also be combined with each other, a grip element can be provided on the first or second base body for manually releasing the closure parts from each other. For example, such a grip element is flexible. In particular, the grip element can be formed with a textile, leather, rubber or plastic ribbon, a cord or a rope. The textile, leather, rubber or plastic ribbon can include e.g. a tab-like portion which can be grasped manually by a user when the closure device is to be opened or closed. A cord or a rope therefor can form a loop, for example.

In one design variant the grip element is held, in particular movably mounted on a continuous opening of the first or second base body. Such a continuous opening in particular can be a continuous central opening on which at least one tightening element is held as well.

Alternatively, the continuous opening is an opening on the respective first or second base body, which is provided in addition to a centrally or decentrally formed engagement opening.

In principle, the first base body and/or the second base body can at least sectionally be made of a flexible material. Due to the fact that the first base body and/or the second base body are at least sectionally made of a flexible material, the first base body and/or the second base body each can be variably arranged on an associated part, possibly by variable adaptation to the shape of the part.

In this connection, flexible material is understood to be a material which provides an elastic, bendable deformability on the first base body and/or the second base body so that the first base body and/or the second base body—at least in those portions which are made of the flexible material—can be flexibly adapted in their shape.

The use of a flexible material also has an influence on the hold of the closure parts against each other. By using a flexible material, an advantageous (static) friction thus can be provided between the portions of the closure parts in the closed position, which ensures a firm hold of the closure parts against each other.

The use of a flexible material also can effect that the closure device can be quietly opened and closed.

For example, the two portions of the first base body, which between themselves define an engagement opening, and/or the engagement portion of the second base body are made of the flexible material.

The flexible material for example can be a thermoplastic elastomer, in particular a thermoplastic polyurethane (in short: TPU), or a synthetic rubber material, in particular acrylonitrile-butadiene rubber (in short: NBR).

The flexible material can have a fiber content, for example a content of glass fibers, advantageously with a content of less than 15 weight percent (wt-%, based on the total weight of the material).

The advantages and advantageous embodiments as they have been described above analogously are also applicable to the closure devices according to the other aspects so that reference fully is made to what has been explained above.

Closure devices as described above can be used in particular on an article of clothing, for example on a shoe, a jacket, a shirt or the like. Correspondingly, for example a shoe closure can be formed with a proposed closure device. It is also conceivable to use a closure device as described above on a prosthesis, an orthosis or another medical implement. However, this is not to be understood in a limiting sense. A closure device of the type described in principle can be used for connecting parts of any kind with each other.

BRIEF DESCRIPTION OF THE DRAWINGS

The idea underlying the solution will be explained in detail below with reference to embodiments illustrated in the Figures by way of example.

DESCRIPTION OF THE INVENTION

Figure 1A:
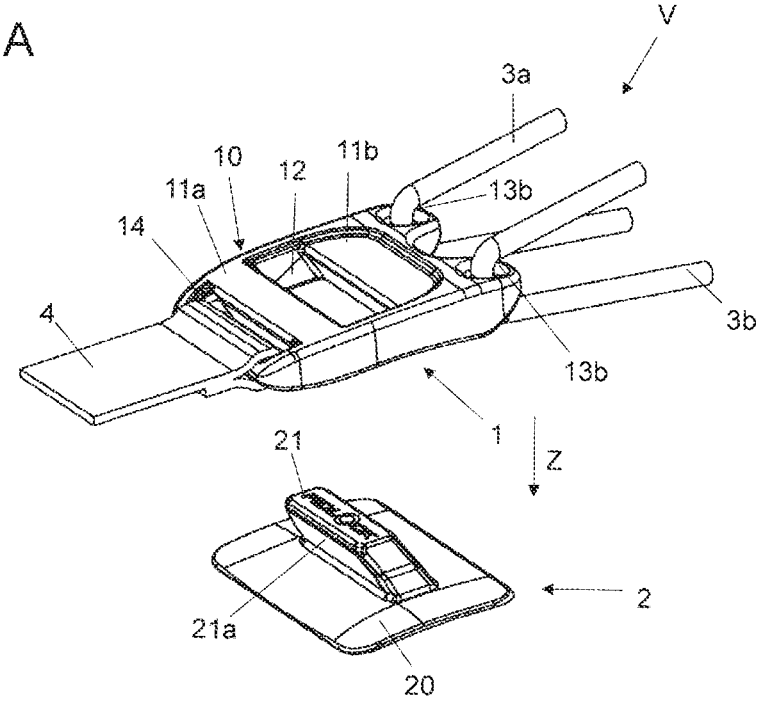
FIGS. 1A-1E show various views of a first design variant of a proposed closure device in which a web-like engagement portion of a second closure part passes through an engagement opening configured as a through opening of a first closure part on which eyelets for flexible tightening elements are provided.

The attached FIGS. 1A-1E, 2A-2C, 3A-3B and 4A-4F by way of example illustrate different design variants of a proposed closure device V in which two closure parts 1 and 2 include first and second base bodies 10, 20 via which the two closure parts 1 and 2 are positively connected with each other to at least partly support a load Fa, Fb acting along a load direction, and an attachment of the two closure parts 1 and 2 to each other as well as a retention of the closure pars 1 and 2 against each other is magnetically supported in a closed position.

In the illustrated exemplary embodiments a plurality of (permanent) magnets 101*a*, 101*b*, 201, 201*a*, 201*b* are provided for the magnetic attraction of the first and second closure parts 1 and 2, which for example are arranged in receiving openings 10*a*, 10*b* of a base body 10 formed therefor. Alternatively, a corresponding (permanent) magnet at least can also be embedded in the material of which the respective base body 10 or 11 is made. It can also be provided that at least one base body 10 or 20 is at least partly made of a ferromagnetic or magnetized material or consists of a magnet.

The design variants of FIGS. 1A to 4F each show a closure device V which can be used for a closure on an article of clothing. In particular, the illustrated design variants can be used as part of a shoe closure so that at least one tightening element 3, 3*a*, 3*b* each engaging a first base body 10 of a first closure part 1 can be a shoelace, while the second closure part 2 with its base body 20 is provided on an upper of the shoe, for example in the vicinity of a tongue of the shoe.

In the design variant of FIGS. 1A to 1E a continuous engagement opening 12 is formed between engagement portions 11*a*, 11*b* spaced apart from each other (along a load direction) on the first base body 10 of the first closure part 1. In a closed position shown in FIGS. 1B, 1D and 1E an engagement portion 21 protruding from a second base body 20 of the second closure part 2 in the manner of a web engages into this engagement opening 12.

Figure 1B:
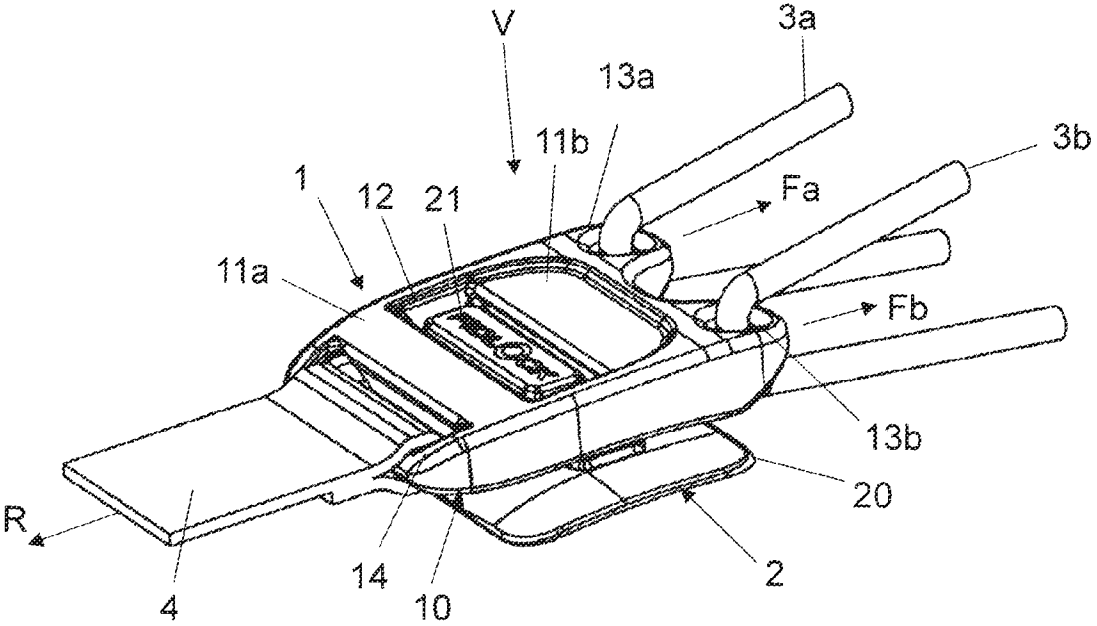
Figure 1C:
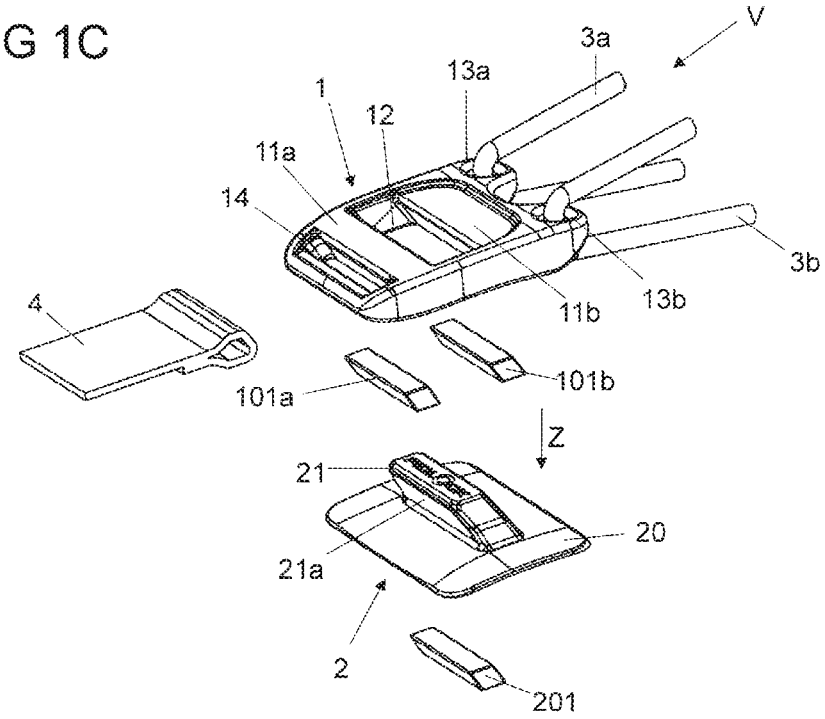
Figure 1D:
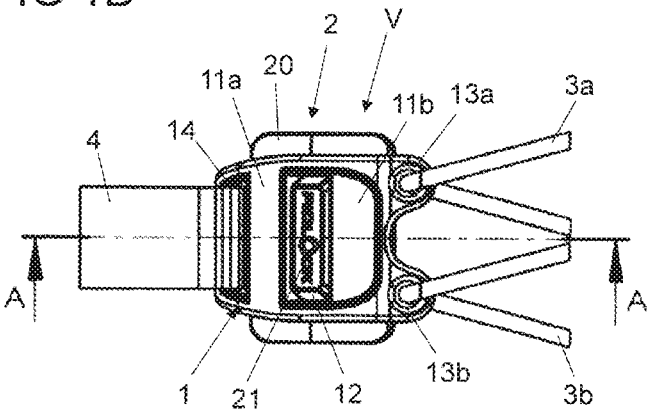
Figure 1E:
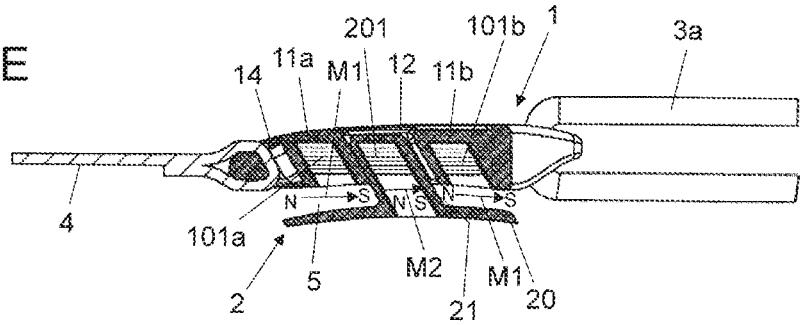

As is clearly shown in particular with reference to the exploded view of FIG. 1E and the sectional view of FIG. 1E, permanent magnets 101*a*, 101*b* and 201 are arranged both in the engagement portions 11*a*, 11*b* of the first base body 10 and in the engagement portion 21 of the second base body 20 protruding in the manner of a web. The (first) permanent magnets 101*a* and 101*b* on the first base body 10 have a first magnetization direction M1 (cf. FIG. 1E) which points from a north pole N to a south pole S of the respective first permanent magnet 101*a*, 101*b*. Correspondingly, the engagement portion 21 of the second base body 20 comprises a second permanent magnet 201 with a second magnetization direction M2 which points from a north pole N to a south pole S of the second permanent magnet 201. In the illustrated closure device V the permanent magnets 101*a*, 101*b* and 201 are arranged in recesses or receiving openings provided therefor in the engagement portions 11*a*, 11*b* and 21.

For closing the closure device V the first closure part 1 and the second closure part 2 can be attached to each other along a closing direction Z such that the closure device V takes the closed position. In the closed position, the base bodies 10 and 20 of the first and second closure parts 1 and 2 extend substantially parallel to each other and perpendicularly to the closing direction Z.

In the closed position, an attractive magnetic force which is directed substantially perpendicularly to the closing direction Z each acts between the engagement portion 21 of the second closure part 2 on the one hand and each of the two engagement portions 11*a*, 11*b* of the first closure part 1, which form the engagement opening 12, on the other hand, corresponding to the orientation of the north and south poles N, S facing each other. The attractive magnetic forces directed perpendicularly to the closing direction Z safely hold the closure device V in its closed position.

For generating the attractive magnetic forces in the closed position, the permanent magnets 101*a*, 101*b* and 201 are arranged in the respective engagement portions 11*a*, 11*b* and 21 such that the first magnetization direction M1 and the second magnetization direction M2 extend parallel to each other and are directed substantially perpendicularly to the closing direction Z. In the closed position, the magnetization directions M1 and M2 as well as the attractive magnetic forces thus extend substantially parallel to the base bodies 10 and 20. In this way, a particularly simple closing operation becomes possible, as a user merely has to attach the closure parts 1, 2 to each other along the closing direction Z.

In the closed position, the first magnetization direction M1 of the permanent magnets 101*a*, 101*b* arranged in the engagement portions 11*a*, 11*b* of the first closure part 1 and the second magnetization direction M2 of the second permanent magnet 201 arranged in the engagement portion 21 of the second closure part 2 extend parallel to each other and are directed substantially perpendicularly to the closing direction Z. With respect to the first magnetization direction M1 and the second magnetization direction M2 the engagement portions 11*a*, 11*b* and 21 are arranged one behind the other. The attractive magnetic forces correspondingly directed perpendicularly to the closing direction Z also hold the closure device V in its closed position when a shear force is applied to the closure parts 1, 2, unless the shear force exceeds the magnetic forces. An inadvertent opening of the closure device V can be prevented in this way.

The engagement portion 21 of the second closure part 2 has the basic shape of a parallelogram non-right-angled in cross-section so that an abutment surface 21*a* of the engagement portion 21 of the second closure part 2 is inclined both to the closing direction Z and to a load direction which is introduced into the closure device V via shoelaces 3*a*, 3*b* engaging the first closure part 1. Correspondingly, the engagement portion 21 of the second closure part 2 extends with an inclination to the closing direction Z and in the closed position is brought into a self-amplifying abutment with an associated engagement portion 11*a* of the first closure part 1 which borders the engagement opening 12. Due to the inclination of the abutment surface 21*a* it is effected in particular that under a load acting in the load direction corresponding to the forces Fa, Fb on the second closure part 2 as shown in FIG. 1B a force component—by force deflection—acts on the engagement portion 21 of the second closure part 2 in the direction of an engagement with the engagement opening 12 between the engagement portions 11*a*, 11*b* of the first closure part 1 so that under a load the engagement is additionally secured.

The base body 10 of the first closure part 1 of the design variant of FIGS. 1A to 1E includes two fastening eyelets 13*a* and 13*b* at an end located in the magnetization direction M1 or M2. These fastening eyelets 13*a* and 13*b* are formed on the first base body 10 of the first closure part 1. Through the fastening eyelets 13*a* and 13*b* a portion of the shoelaces 3*a*, 3*b* each is guided and thereby held on the first closure part 1. On the base body 10 including the engagement opening 12 with the engagement portions 11*a* and 11*b* carrying the permanent magnets 101*a*, 101*b* fastening eyelets 13*a* and 13*b* for the shoelaces 3*a* and 3*b* thus are formed so that the shoelaces 3*a*, 3*b* are tightened by pulling on the first closure part 1, and by maintaining the tension of the shoelaces 3*a*, 3*b* the first closure part 1 can be attached to the second closure part 2 with magnetic support.

To facilitate gripping the first closure part 1 on opening and closing of the closure device V, a grip tab or grip element 4 is provided on the first closure part 1. This grip element 4 for example is formed by a textile, leather, rubber or plastic ribbon and at a front end of the first closure part 1 is held at a clevis 14 of the first base body 10. A portion of the grip element 14 thus wraps around a transverse web bordering the clevis 4 on the first base body 10.

A user of the closure device V can grasp the grip element 4 by a protruding tab-like portion of the grip element 4 and for example lift the first closure part 1 in the closed position from the second closure part 2 by pulling along a displacement direction R which extends opposite to the load direction, which is applied by the tightened shoelaces 3*a* and 3*b*. By pulling the grip element 4 along the displacement direction R, the first base body 10 of the first closure part 1 and in particular its engagement portion 21 can be displaced with respect to the second closure part 2 to such an extent that the engagement portion 21 with its abutment surface 21*a* no longer positively and non-positively rests against the engagement portion 11*a* of the first closure part 1 and hence the first closure part 1 can be lifted from the second closure part 2 and hence can be released.

As is shown in FIG. 1D in particular with reference to the sectional representation along the sectional line A-A of FIG. 1C, a clearance 5 is present between the first and second closure parts 1 and 2 in the closed position. Between an upper side of the second base body 20, from which the engagement portion 21 protrudes, and an underside of the first base body 10 of the first closure part 1 with the engagement opening 12 a gap-shaped clearance 5 thus is present on both sides of the engagement portion 21 protruding in the manner of a web. This clearance 5 can serve as an additional dipping reserve in order to for example displace the first closure part 1 further in the closing direction Z along the engagement portion 21 of the second closure part 2 in the case of a higher load. Furthermore, the clearance 5 can simplify the connection of the second base body 20 of the second closure part 2 to shoe materials, and in particular shoe fabrics, of different thickness. For this purpose, a gap height of the clearance 5 then is dimensioned such that materials of different thickness can be arranged in the clearance 5 with one portion.

For example, in the design variant of FIGS. 1A to 1E the first and second base bodies 10 and 20 can be designed at least partly flexible, although this is of course not absolutely necessary. In the second base body 20 of the second closure part 2 for example a flatly extending base, from which the engagement portion 20 protrudes in the manner of a web, can be configured flexible, while the engagement portion 21 itself is rigid.

Figure 2A:
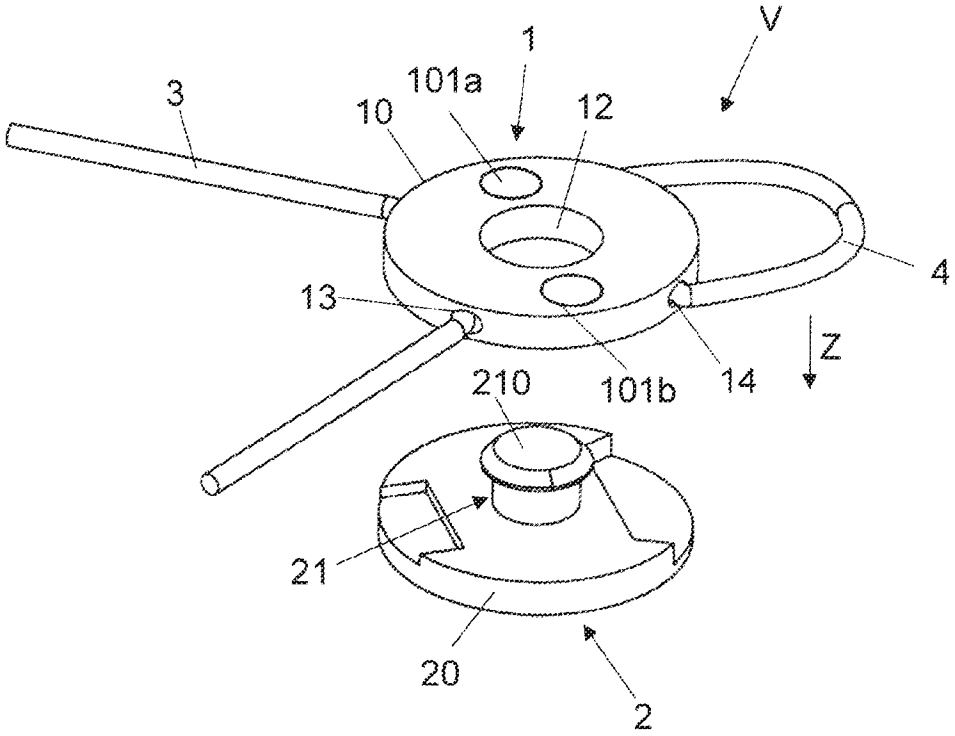
FIGS. 2A-2C in various views show a further design variant of a proposed closure device with a circular ring-shaped first base body of a first closure part, in whose engagement opening configured as a through opening a rotationally symmetrical engagement portion with a mushroom-head-shaped end portion of a second base body of a second closure part lockingly engages in the closed position and on which a through opening extending in the manner of a channel is formed for connecting a tightening element with the first base body.
Figure 2B:
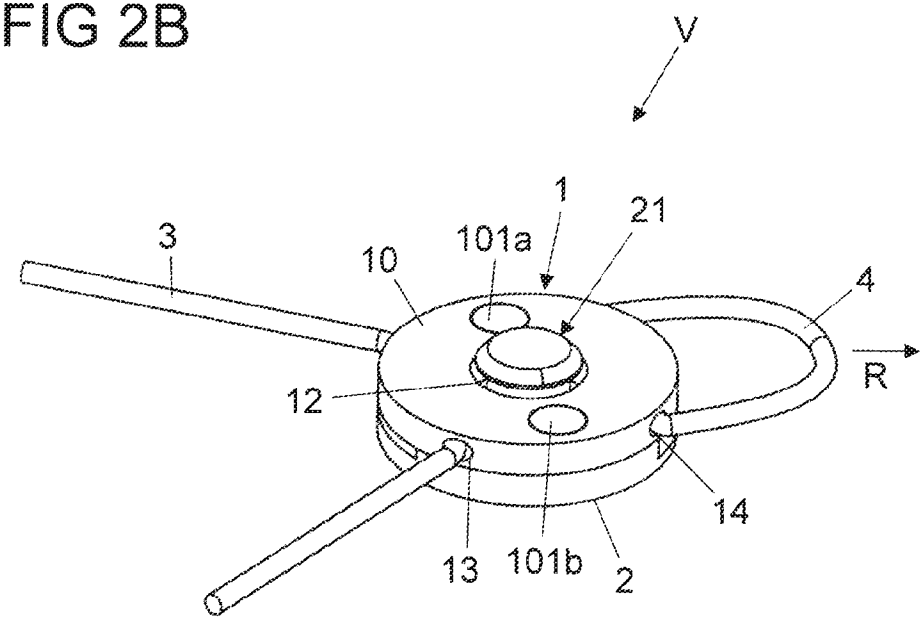
Figure 2C:
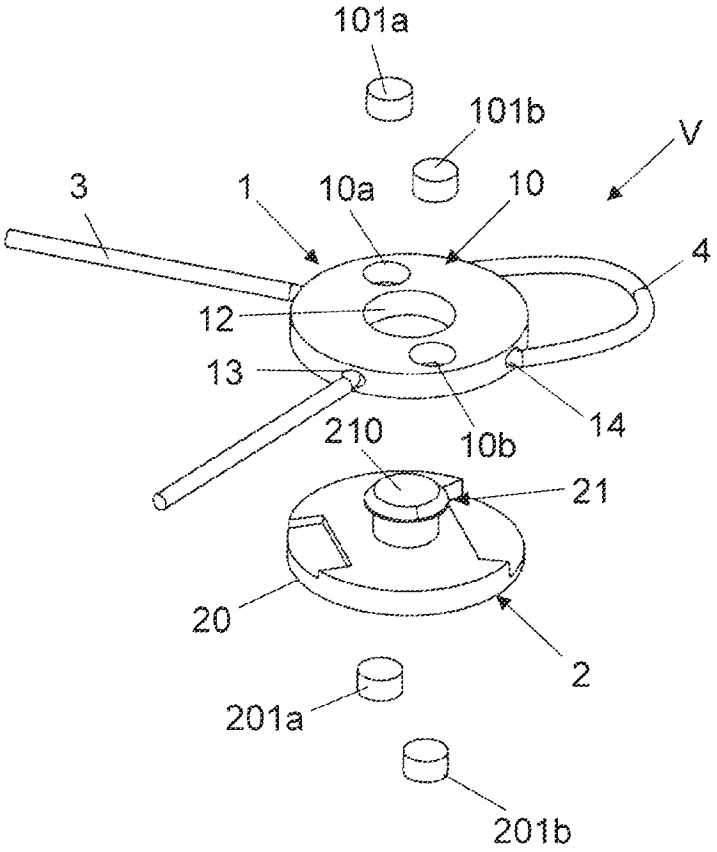

In the design variant of FIGS. 2A to 2C the second closure part 2 is configured with a disk-shaped second base body 20 on which a pin-like protruding engagement portion 21 with a mushroom head 210 is centrally formed as an undercut region. In the closed position, the engagement portion 21 with the mushroom head 210 passes through a centrally arranged engagement opening 12 in a circular disk-shaped first base body 10 of a first closure part 1 of the design variant of FIGS. 2A to 2C. In the closure device V of FIGS. 2A to 2C an arrestment of the two closure parts 1 and 2 at each other independent of the direction is possible via the rotationally symmetrical configuration of the engagement portion 21 with the rotationally symmetrical mushroom head 210.

When a load is applied via a shoelace 3 connected with the first closure part 1, it is ensured that the first closure part 1 cannot easily be separated from the second closure part 2 and in particular the mushroom head 210, in that the mushroom head 210 at least partly engages over an (inner) edge of a portion of the first base body 10 bordering the engagement opening 12. Due to the load on the first closure part 1, which is applied via a shoelace 3, the first closure part 1 is displaced transversely to a longitudinal axis of the protruding pin-like engagement portion 21 with the mushroom head 210 so that a protruding edge of the mushroom head 210 at least partly engages over the inner edge of the engagement opening 12 of the first base body 10. The first base body 10 hence can only be lifted from the second base body 20 of the second closure part 2 and in particular from the pin-like engagement portion 21 after the first base body 10 has been pulled along the displacement direction R opposite to the load direction and a middle axis of the engagement opening 12 and a longitudinal axis of the protruding pin-like engagement portion 21 with the mushroom head 210 again are coaxial to each other.

For the easier handling and in particular the displacement of the first closure part 1, a flexible grip element 4 extending in the manner of a loop is held on the first base body 10 in the design variant of FIGS. 2A to 2C. A portion of a string, a rope or a cord of the grip element 4 is guided through a through opening 14 on the first base body 10. This through opening 14 traverses the circular ring-shaped first base body 10 of the first closure part 1 substantially parallel to a disk plane and hence for example along a secant of a circle enclosing the contour of the first base body 10.

Analogously, there is provided a fixing opening in the form of a fixing channel 13 traversing the first base body 10, through which a portion of the shoelace 3 extends.

To magnetically support the attachment of the two closure parts 1 and 2 also in the design variant of FIGS. 2A to 2C, permanent magnets 101*a*, 101*b* or 201*a*, 201*b* are provided on both closure parts 1 and 2. These permanent magnets 101*a*, 101*b*, 201*a*, 201*b* are arranged on the first base body 10 in receiving openings 10*a*, 10*b* radially spaced from the central engagement opening 12 or on the second base body radially spaced from the central pin-like protruding engagement portion 21 including the mushroom head 210.

The arrangement of these permanent magnets 101*a*, 101*b*, 201*a*, 201*b* here for example is chosen such that in the closed position and without a load being applied on the first closure part by tightening the shoelace 3 an undercut region provided by the radially protruding edge of the mushroom head 210 is not in engagement with the first base body 10 of the first closure part. Only on application of a load and after a resulting movement of the first and second base bodies relative to each other the mushroom head 210 positively engages over the first base body 10 of the first closure part 1 on the inner edge of the engagement opening 12.

Alternatively, the permanent magnets 101*a*, 101*b*, 201*a*, 201*b* can be arranged such that already in an unloaded condition of the closure device V the undercut provided by the mushroom head 210 is in engagement. Via the magnets 101*a*, 101*b*, 202*a*, 202*b* it here is ensured for example with a corresponding arrangement that the two base bodies 10 and 20 of the first and second closure parts 1 and 2 are displaced relative to each other in the case of the magnetically supported transfer into the closed position (also) transversely to the closing direction Z and hence transversely to the longitudinal axis of the protruding pin-like engagement portion 21.

Figure 3A:
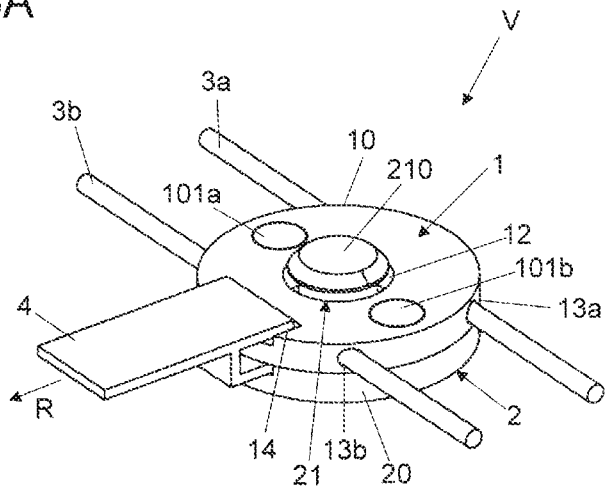
FIGS. 3A-3B in various views show a further design variant of a proposed closure device with a circular ring-shaped first base body of a first closure part analogous to the design variant of FIGS. 2A to 2C, but with a differently designed connection to a plurality of flexible tightening elements.
Figure 3B:
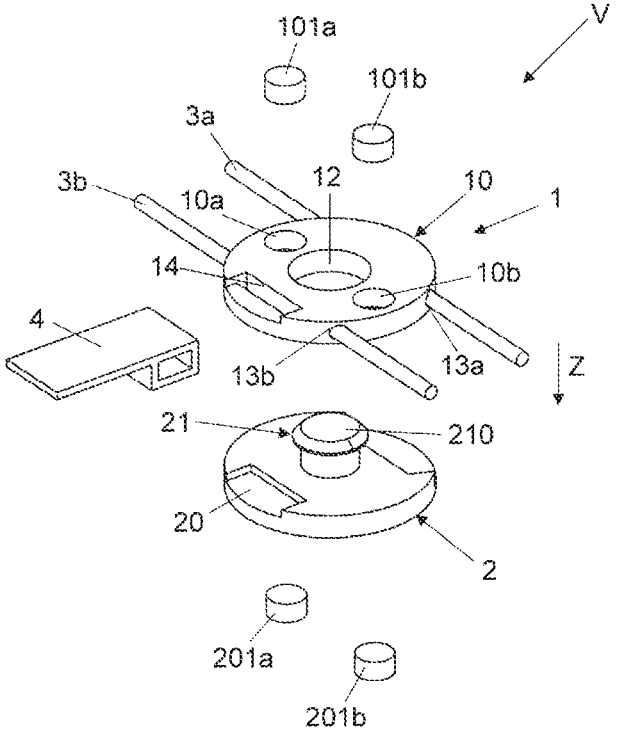
Figure 4A:
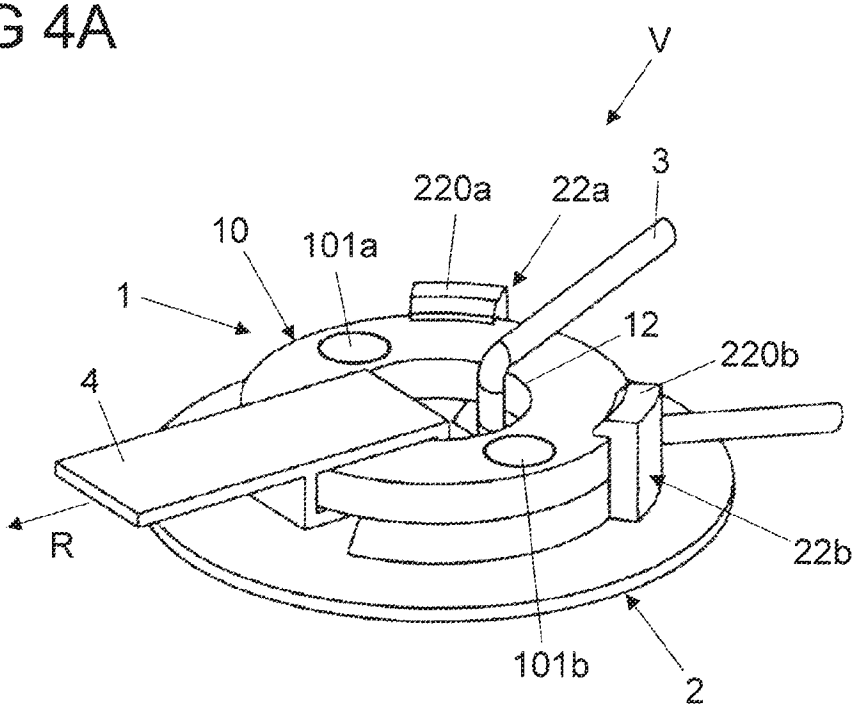
FIGS. 4A-4F in various views show a further design variant of a proposed closure device with a circular ring-shaped first base body of a first closure part, in which a tightening element and a grip element are held on a central through opening and which in the closed position is positively held on the second base body of the second closure part by web-like protruding (latching) portions with an undercut region.
Figure 4B:
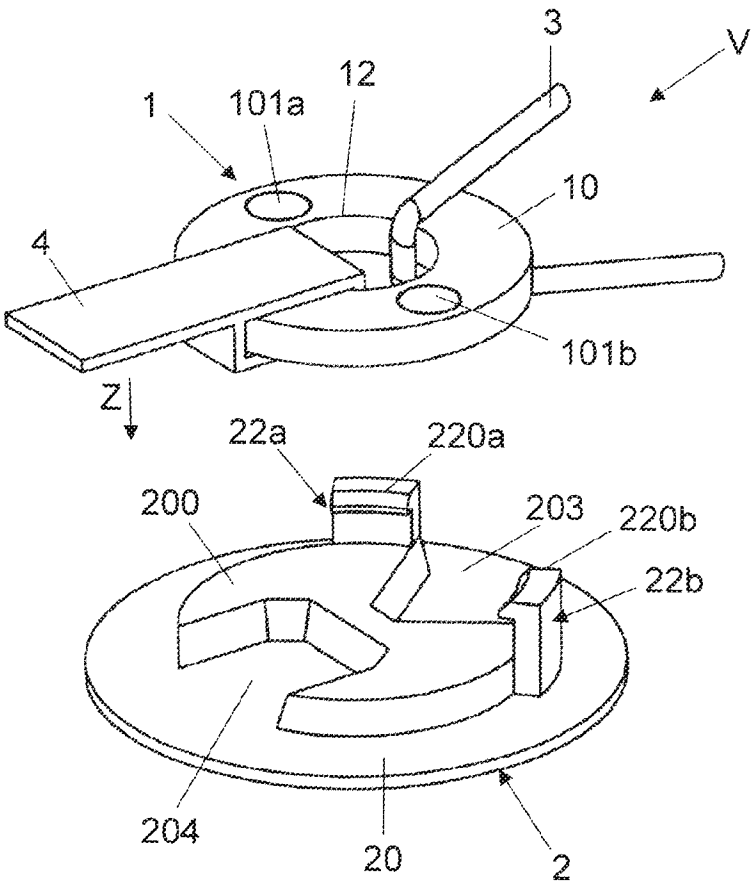
Figure 4C:
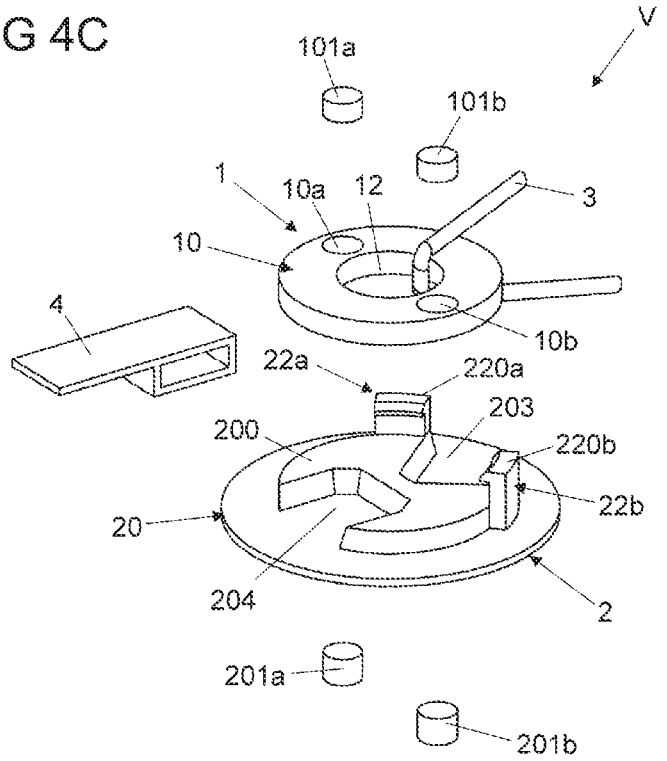
Figure 4D:
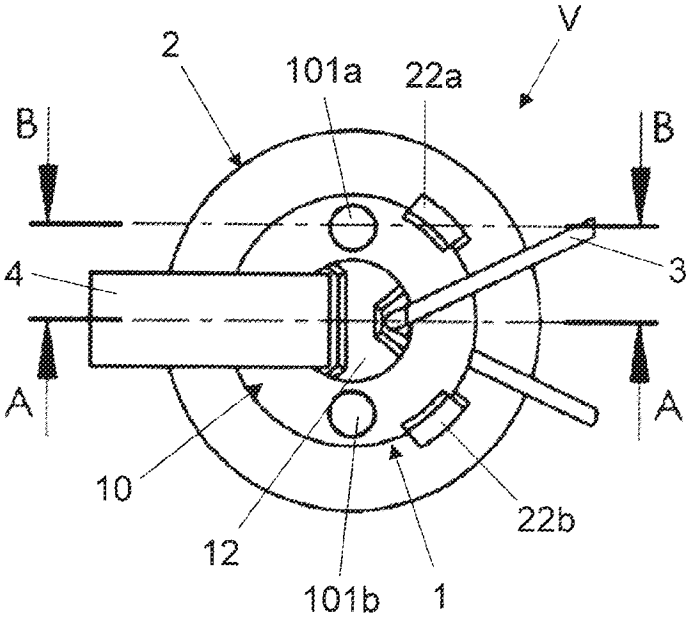
Figure 4E:
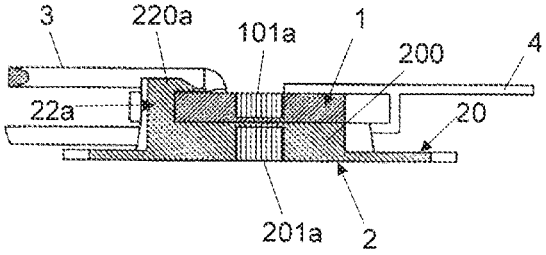
Figure 4F:
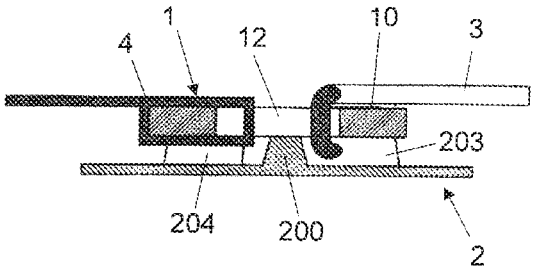

The design variant of FIGS. 3A and 3B to a large extent functionally corresponds to the design variant of FIGS. 2A to 2C. In contrast to the design variant of FIGS. 2A to 2C a closure device V of FIGS. 3A and 3B merely provides among other things that a grip element 4 is not formed by a cord-like flexible element, but again by a ribbon which is movably held on a clevis 14 of the first base body 10 of the first closure part.

In addition, the grip element 4 with its tab-like protrusion is not oriented substantially opposite to the direction of the load applied via a shoelace 3 like in the design variant of FIGS. 2A to 2C (or of FIGS. 1A to 1E). Rather, the grip element 4 with its tab-like protrusion here extends substantially at an angle of 90° to two shoelace pairs 3*a*, 3*b* which are fixed to the first base body 10 of the first closure part 1. The two shoelaces 3*a* and 3*b* here are guided through fixing channels 13*a* and 13*b* through the first base body 10, which extend parallel to each other and each along secants on both sides of the central engagement opening 12.

In the design variant of FIGS. 4A to 4F, a first closure part 1 is formed with a circular ring-shaped base body 10. A central opening 12 of the first base body 10 however does not serve as an engagement opening for an engagement portion of a second closure part 2 like e.g. in the design variant of FIGS. 2A-2C and 3A-3B. The central opening rather is provided as a fixing opening on the first base body of the design variant of FIGS. 4A to 4F, through which both a portion of a shoelace 3 and a portion of a flexible grip element 4 are guided and are held on the first base body 10 of the first closure part 1.

In the design variant of FIGS. 4A to 4F, securing the closed position and an absorption of shear and tilting forces with a closed closure device V is achieved via latching portions in the form of latching webs 22*a* and 22*b* which are formed on a disk-shaped base body 20 of a second closure part 2 shown here by way of example. These latching webs 22*a* and 22*b* protrude from a base surface of the second base body 20 substantially perpendicularly (opposite to the closing direction Z). Under the influence of the permanent magnets 101*a*, 101*b* and 201*a*, 201*b* of the base bodies 10 and 20 of the two closure parts 1 and 2, which magnetically attract each other, the two base bodies 10 and 20 are properly arranged relative to each other in the closed position such that latching hooks 220*a* and 220*b* defining undercut regions at upper ends of the latching webs 22*a*, 22*b* circumferentially, i.e. at an outer edge, engage over the base body 10. The latching hooks 220*a* and 220*b* thus each circumferentially engage over a portion of the first base body 10 which borders the central fixing opening 12, and thus secure the closed position of the closure device V.

On the disk-shaped second base body 20 of the second closure part 2 a platform 200 furthermore is formed, which protrudes in the direction of the first base body 10 of the first closure part 1 and on whose upper side the first base body 10 rests with its underside in the closed position. The platform 200 includes two cutouts 203 and 204 facing each other. Via a first cutout 203 jamming of the grip element 4 between the two base bodies 10 and 20 is prevented so that in the closed position the grip element 4 at least partly extends through this first cutout and the grip element 4 continues to be movable and in particular pivotable also in the closed position. In the closed position, the second cutout 203 in the platform 200 analogously prevents pinching of the shoelace 3 between the two first and second base bodies 10 and 20. Thus, the shoelace 3 threaded into the central fixing opening 12 of the first base body 10 just like the flexible grip element 4 continues to be movable relative to the closure parts 1 and 2 also in the closed position.

In particular in the design variant of FIGS. 4A to 4F (but also in the remaining design variants explained above) it can also be provided instead of the separate permanent magnets 101*a*, 101*b*, 201*a*, 201*b* arranged on a base body 10 or 20 that the respective base body 10 or 20 is completely or partly made of a magnetic or ferromagnetic material. In this way, e.g. the circular ring-shaped first base body 10 can also be formed by or with a metallic washer.

Advantageously—also in the case of a different realization of the magnetic support—it is ensured in a design variant according to FIGS. 4A to 4F that under the influence of the attractive magnetic forces the first and second closure parts 1 are aligned relative to each other in the closed position such that the region of the first base body 10 of the first closure part 1, which is engaged by the shoelace 3, lies between the two latching webs 22*a* and 22*b* and occurring tilting forces hence can be absorbed by the latching webs 22*a* and 22*b*.

The idea underlying the solution is not limited to the exemplary embodiments described above, but can also be realized in a completely different way.

A closure device as described here can be used in a completely different way, for example on an article of clothing, for example on a shoe, a jacket, a shirt or the like.

In a concrete embodiment, a shoe, in particular a sports shoe, includes a closure device as described here. The closure device serves e.g. for closing and possibly tightening the shoe (for example in the case of a ski boot). Correspondingly, a shoe closure can be formed with a proposed closure device.

A proposed closure device can, however, also be used for example on a medical implement, for example on an orthosis or a prosthesis.

As magnet, discrete magnetic elements can be used for example, which are inserted for example into associated cutouts on the base body and are glued to the base body, for example by using an epoxy adhesive.

The magnets can each be formed by a permanent magnet element. Alternatively, it is also conceivable to provide for example permanent magnet elements on one closure part, but on the other closure part passive magnet elements in the form of ferromagnetic armatures which cooperate with the permanent magnets in a magnetically attractive manner.

Alternatively, it is in turn also conceivable to manufacture the base bodies of the closure parts themselves at least partly from a magnetic, ferromagnetic or magnetized material, instead of discrete elements.

LIST OF REFERENCE NUMERALS

1 first closure part
10 base body
101*a*, 101*b* first (permanent) magnet
10*a*, 10*b* receiving opening
11*a*, 11*b* engagement portion
12 engagement opening/fixing opening
13, 13*a*, 13*b* fixing eyelet/fixing channel (fixing opening)
14 clevis
2 second closure part
20 base body
200 platform
201, 201*a*, 201*b* second (permanent) magnet
203, 204 cutout
21 engagement portion
21*a* abutment surface
210 mushroom head (undercut region)
220*a*, 220*b* latching hook (undercut region)
22*a*, 22*b* latching web
3, 3*a*, 3*b* shoelace (tightening element)
4 grip element
5 clearance
Fa, Fb load
M1, M2 magnetization direction
R displacement direction
V closure device
Z closing direction

The invention claimed is:

1. A closure device for releasably connecting two parts with each other, comprising a first closure part which includes a first base body with an engagement opening, and a second closure part which includes a second base body and at least one engagement portion formed on the second base body, wherein the at least one engagement portion extends from an upper surface of the second base body, wherein the first closure part and the second closure part can be attached to each other such that in a closed position the engagement portion is at least partly received in the engagement opening to support a load acting between the first closure part and the second closure part along a load direction, and holding of the first and second base bodies against each other in the closed position is magnetically supported by at least two magnets positioned in the first base body and at least one magnet positioned in the at least one engagement portion, and wherein the engagement opening is formed on the first base body as a through opening through which the engagement portion protrudes in the closed position, and wherein, in the closed position, the at least one magnet positioned in the at least one engagement portion is positioned between the at least two magnets positioned in the first base body.

2. The closure device according to claim 1, wherein in the closed position the engagement portion of the second closure part passes through the engagement opening.

3. The closure device according to claim 1, wherein at least one of the engagement portion protrudes from the second base body in the manner of a web, in particular transversely to the load direction, and two portions formed on the first base body are spaced apart from each other along the load direction and between themselves form the engagement opening configured as a through opening.

4. The closure device according to claim 1, wherein the engagement portion protrudes from the second base body in the shape of a pin, in particular transversely to the load direction.

5. The closure device according to claim 4, wherein the engagement portion protruding in the shape of a pin is at least one of the following:

is of rotationally symmetrical design and comprises a mushroom-head-shaped end portion at an end which in the closed position protrudes into or through the engagement opening.

6. The closure device according to claim 1, wherein the engagement portion includes an abutment surface which in the closed position is in abutment with a portion of the first closure part bordering the through opening to support a load acting on the second closure part in the load direction.

7. The closure device according to claim 6, wherein the abutment surface is inclined relative to the load direction and to a closing direction, along which the first closure part and the second closure part can be attached to each other such that in the case of a load acting on the second closure part in the load direction, the engagement portion is loaded with a force component in the closing direction relative to the first closure part.

8. The closure device according to claim 1, wherein the engagement portion includes an undercut region against which a portion of the first closure part bordering the engagement opening rests in the closed position and when a load acts on the second closure part in the load direction, and which at least partly engages over the portion bordering the engagement opening.

9. The closure device according to claim 1, wherein in the closed position the retention of the first and second closure parts against each other is magnetically supported by at least one magnet of the first or second closure part.

10. The closure device according to claim 1, wherein between the first base body and the second base body a predefined clearance is formed in the closed position.

11. The closure device according to claim 1, wherein a grip element is provided on the first or second base body for manually releasing the closure parts from each other.

12. The closure device according to claim 11, wherein the grip element is at least one of the following:

is flexible and is held on a continuous opening of the first or second base body.

13. A shoe closure with a closure device according to claim 1.

14. An article of clothing with a closure device according to claim 1.

* * * * *